United States Patent [19]

Schrecongost

[11] 4,160,400

[45] Jul. 10, 1979

[54] TOUCH RESPONSIVE KEYING UNIT FOR ELECTRONIC MUSICAL INSTRUMENTS

[75] Inventor: Ray B. Schrecongost, Park Ridge, Ill.

[73] Assignee: Marmon Company, Chicago, Ill.

[21] Appl. No.: 617,538

[22] Filed: Sep. 29, 1975

[51] Int. Cl.[2] ..... G10H 3/00

[52] U.S. Cl. ..... 84/1.13; 84/1.1; 84/1.14; 84/DIG. 7

[58] Field of Search ..... 84/1.13, 1.01, 1.10, 84/1.11, 1.14, 1.16, 1.24, 1.27, DIG. 7; 340/365 C

[56] References Cited

U.S. PATENT DOCUMENTS

| | | | |
|---|---|---|---|
| 2,314,496 | 3/1943 | Hammond | 84/1.14 |
| 2,623,996 | 12/1952 | Gray | 84/1.14 |
| 2,809,547 | 10/1957 | Caine | 84/DIG. 7 |
| 2,931,877 | 4/1960 | Henlei | 84/1.27 |
| 3,165,022 | 1/1965 | Yokotama | 84/1.14 |
| 3,248,470 | 4/1966 | Markowitz | 84/1.27 |
| 3,255,293 | 6/1966 | Walker | 84/1.1 |
| 3,293,640 | 12/1966 | Chalfin et al. | 340/365 C |
| 3,480,744 | 11/1969 | Yamada | 84/1.27 |
| 3,636,232 | 1/1972 | Hiyama | 84/DIG. 7 |
| 3,769,869 | 11/1973 | Nelson, Jr. | 84/1.01 |
| 3,943,812 | 3/1976 | Nagai et al. | 84/1.1 |

*Primary Examiner*—Robert K. Schaefer
*Assistant Examiner*—Vit W. MIska
*Attorney, Agent, or Firm*—Neuman, Williams, Anderson & Olson

[57] ABSTRACT

A touch responsive unit for a keyboard electronic musical instrument. A high frequency signal source is connected to one plate of a normally open circuited variable capacitor. The other plate of the variable capacitor being mechanically connected to a force transferring mechanism and electrically connected to a circuit means for generating a control voltage envelope. The depressive force applied to the key through the transfer mechanism causes the capacitor plates to overlap. The degree of area overlap is proportional to the depressive force and determines the capacitance value. As the plate area cverlap increases, the capacitance value increases and the peak amplitude of the high frequency source passed by the capacitor increases. The control voltage envelope of the circuit means is applied to a standard keyer circuit to amplitude modulate a tone signal source corresponding to the selected key. The slope or decay rate of the control voltage envelope is regulated by the circuit means.

26 Claims, 3 Drawing Figures

TOUCH RESPONSIVE KEYING UNIT FOR ELECTRONIC MUSICAL INSTRUMENTS

BACKGROUND

The present invention relates to a touch responsive keying unit for an electronic keyboard musical instrument. In standard electronic key operated musical instruments the depression of individually selectable keys from the keyboard produce different tone signals. However, the volume of these tone signals is constant and independent of the depressive force applied to the key. In this type of instrument it is common to employ a separate, manually operative volume controller to collectively vary the level of the tone signals. This standard electric keyboard musical instrument fails to provide the instrument player with the same feel when the keys are depressed as is experienced in a non-electric kay instrument wherein the depression of a key mechanically causes a hammer to strike a string, and it furthermore fails to provide an output tone signal with varying peak amplitude.

Prior art touch responsive units have commonly attempted to overcome these disadvantages by the use of circuits which involved the controlled closing of manual switches to produce a voltage for controlling a keyer circuit. The control voltage produced depended upon the speed of contact closure. Other prior art devices produced a control signal by the depression of a key which moved a magnet past an associated coil. However, these and other prior art devices failed to simulate the correlation between the force applied to the key and the initial amplitude level of tone signal output and the subsequent variable slope of decay of the tone signal amplitude which is obtainable by mechanical damping in non-electric instruments. Furthermore, the assembly of the magnetic touch responsive devices was frequently difficult and expensive due to the necessity of providing close tolerance of the flux gaps in the magnetic circuit.

SUMMARY OF THE INVENTION

The touch responsive keying unit of the present invention comprises a mechanism for generating an AC voltage signal at a peak amplitude corresponding to the depressive force applied to the key and a circuit means to receive the AC signal and produce an output control voltage which regulates the amplitude of the tone signal output corresponding to the selected key. The mechanism for generating the AC signal comprises a velocity responsive transducer and a high frequency signal source connected to the transducer. The velocity transducer comprises a force translation mechanism and a variable capacitor unit. The variable capacitor unit includes a U-shaped, movable plate and a fixed or non-movable plate of mylar or the like with an electrically conductive coating. The fixed plate is positioned within a channel formed through the U-shaped movable plate. The movable plate is connected to the force translation mechanism which is responsive to the depression of the key.

In the rest position the movable plate does not effectively overlap the electrically conductive coating of the fixed plate. When the key is depressed the linking means of a force translation mechanism moves the U-shaped plate toward an overlap condition with the electrically conductive portion of the fixed plate. The greater the force applied to the key the greater the movement of the U-shaped plate toward the overlap condition. A high-frequency signal source is connected to the plate and the movable plate is connected to the circuit means for generating the control voltage. The degree of plate overlap relates to the capacitance of the transducer and the depressive force applied to the key. As the capacitance value of the velocity transducer varies, the maximum amplitude of the high-frequency AC signal passed to the circuit means proportionally varies.

The AC signal is received by the circuit means which comprises a variable impedance input switching circuit to pass only one polarity of the signal. The variable impedance circuit output is rectified and stored. The stored voltage begins to dissipate through a dual slope discharge circuit comprising separate branches with different discharge rates. The envelope of the discharging voltage is impressed upon a keyer circuit to control the amplitude of the tone signal. The discharge branch circuit through which the stored voltage passes is partially dependent upon the position of the key.

An object of the present invention is to provide a touch responsive unit for controlling the level of a tone signal produced corresponding to the key selected.

A further object is to provide a mechanism which produces a signal proportional to the depressive force applied to a key and which simulates the movement of a standard non-electric instrument key.

An additional object is to use a variable capacitive transducer to pass a signal proportional to the depressive force applied to a key and transferred to a movable plate of the capacitor.

An additional object is to provide a variable capacitor with a movable and a fixed plate which have no critical dimensional tolerance in manufacture and assembly.

An additional object is to provide a circuit which is responsive to a signal proportional to the depressive force applied to a key and to the position of the key for producing an output signal envelope for controlling the level of a tone signal corresponding to the key depressed.

BRIEF DESCRIPTION OF THE DRAWINGS

Further and additional objectives will appear from the following detailed description of the specific embodiment read in conjunction with the accompanying drawings, wherein.

DETAILED DESCRIPTION

Figure 3:
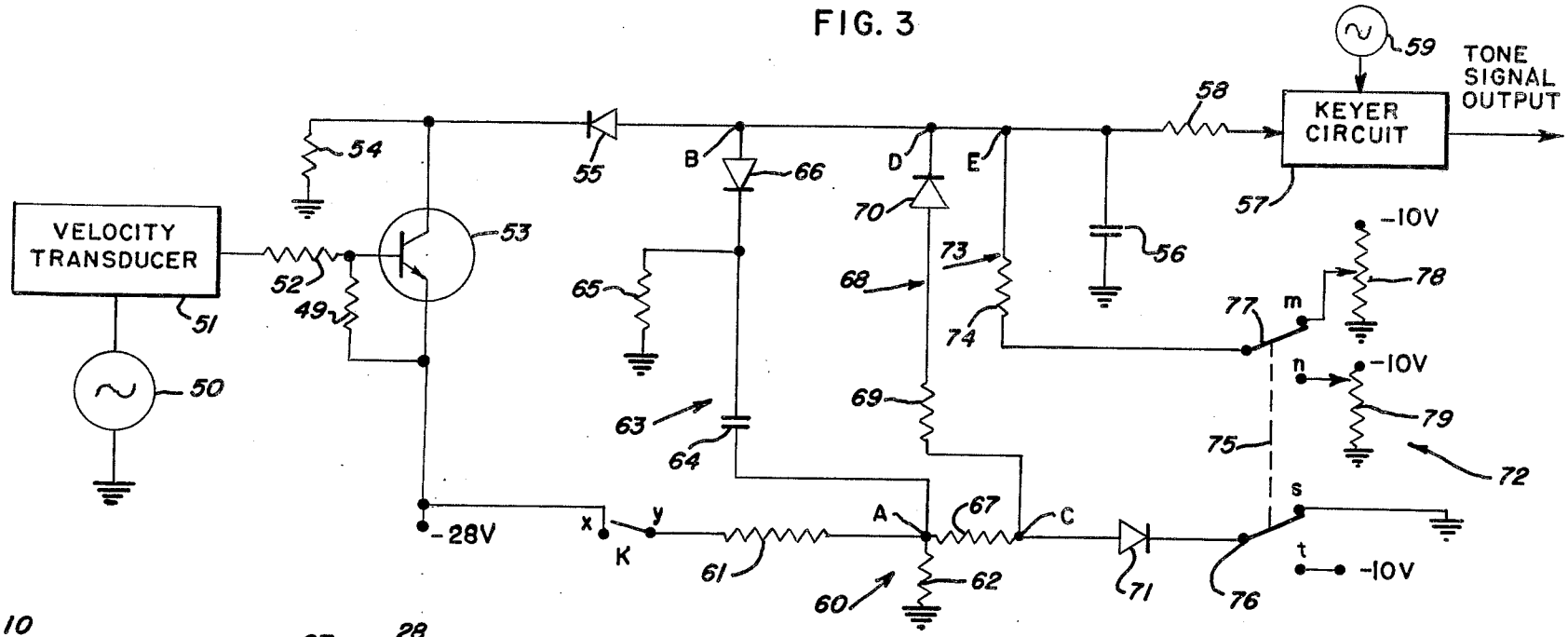
FIG. 3 schematically illustrates the circuit means for producing the signal to control the keyer circuit.
Figure 1:
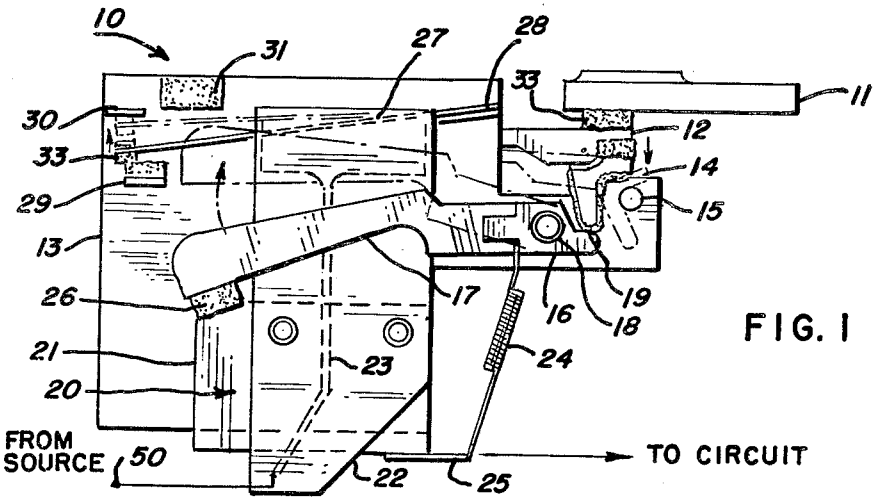
FIG. 1 illustrates the touch responsive mechanism, including the variable capacitive transducer in the rest and fully engaged positions.

A standard musical keyboard has a plurality of juxtapositioned keys arranged in the order of musical notes from one end of the keyboard to the other. As illustrated in FIG. 1, a touch responsive mechanism 10 is associated with each individual key 11. The key 11 is graphically depicted in FIG. 1 for simplicity but it should be understood that the key 11 would be mounted in any standard manner such as pivotally mounted about a fulcrum and secured to the frame of the instrument to maintain the key in a substantially horizontal neutral position. When the key 11 is depressed, it operates a standard keyboard contact K, as schematically shown in FIG. 3 and engages its associated touch responsive mechanism.

When the key 11 is depressed it contacts the free end of the cantilever beam 12 and forces it downward. The other end of the beam 12 is secured to the base 13 of the touch responsive mechanism 10. Pivotally secured to the free end of the beam 12 is an L-shaped drive member 14. The drive member 14 is pivoted at the juncture between its horizontal and vertical leg sections. A contact rod 15 is attached to the base 13. The rod 15 extends perpendicularly outward and is slightly beneath the horizontal leg section of the drive member 14. A receiving block 16 is attached to one end of the movable capacitor plate 17. The movable plate 17 is pivotally secured to the base 13 at point 18. The movable plate 17 forms a projecting U-shaped channel. The surface 19 of the receiving block 16 is a specially curved surface.

Figure 2:
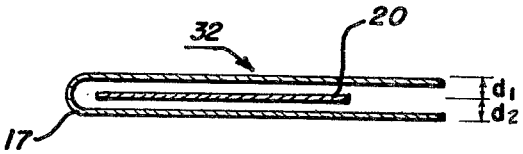
FIG. 2 illustrates the fixed plate within the movable U-shaped plate of the variable capacitor.

A fixed or stationary capacitor plate 20 is secured to an insulating mounting board 21. The board 21 as secured to the base 13 slightly off-sets the fixed plate 20 from the base 13. Thus, the base 13 and the fixed capacitor plate 20 are in parallel planes. The fixed plate 20 is comprised of two mylar sheets 22 or similar non-conductive material and electrically conductive material 23 deposited or sandwiched therebetween. Thus, the electrically conductive material 23 is insulated on both of its surfaces by the mylar sheets 22. The electrically conductive material 23 forms a pattern; in the preferred embodiment the pattern is generally T-shaped. The fixed capacitor plate 20 is positioned through the channel or slip formed in the movable capacitor plate 17, as shown in FIG. 2.

An input signal source is electrically connected to the long or finger-like section of the electrically conductive material 23. A coil spring 24 is connected between the movable capacitor plate 17 and an extending terminal portion 25 secured to the insulating board 21. The coil spring 24 assists in returning the movable capacitor plate 17 to the neutral or unengaged position with the movable plate 17 contacting the rest member 26 as illustrated by the solid lines in FIG. 1. The spring 24 is electrically conductive and forms a signal path from the movable plate 17 to the terminal 25. The terminal 25 is connected to the circuit means illustrated schematically in FIG. 3. It should be noted that the input and output connections to the velocity transducer could be reversed without change in operation.

A leaf spring 27 is secured to the base 13 above the movable capacitor plate 17 and the upper or head portion of the electrically conductive material pattern 23. One end of the leaf spring 27 is attached to the base 13 at a shelf 28 above the movable plate pivot point 18. The leaf spring 27 extends angularly downward until its free end is positioned on support ledge 29. The support ledge 29 is secured to the base 13 slightly below an initial stop member 30, also attached to the base 13. A second stop member 31 is attached to the base 13 at a point intermediate the length of the leaf spring 27 and above the first or initial stop member 30.

As the instrument player depresses the key 11, the cantilever beam 12 is forced downward. Since the L-shaped drive member 14 is pivotally attached to the beam 12, it is also forced downward. During the downward stroke the horizontal leg section of drive member 14 contacts the rod 15. Due to this contact, the drive member 14 begins to rotate in a counterclockwise direction about the pivot connecting it to the beam 12. This pivot action causes the vertical leg section of drive member 14 to contact the receiving block 16 with an arced sweeping motion. The surface 19 of the receiving block 16 slopes downwardly to complement the sweeping motion of the drive element 14 and to provide unimpeded disengagement and return of drive element 14 after completion of the downward stroke and release of key 11. The contacting surface of the vertical leg section of the drive element 14 which is smoothed or rounded and the surface 19 of the receiving arm 16 operate as camming surfaces. The depressing force exerted against the key 11 is proportionally transferred to the receiving block 16 causing it to move downward about the pivot point 18. The movable capacitor plate 17 rests against member 26 causing the receiving block 16 to be positioned at a slightly upward angle from the horizontal. The angle of receiving block 16 and the degree of slope of surface 19 determines the area of contact between drive member 14 and block 16 which is proportional to the amount of transferred energy or force.

The receiving block 16 is attached to the movable capacitor plate 17. The receiving block 16 is moved downward about point 18 causing the U-shaped channel portion of the movable capacitor plate 17 to move upward. In the rest or neutral position the U-shaped portion is positioned a distance below the head portion of the electrically conductive pattern 23 of the fixed capacitive plate 20. As the U-shaped portion moves upward it begins to overlap the head portion of the pattern 23. The fixed capacitor plate 20 and the movable capacitor plate 17 form a variable capacitor 32. Once the downward movement of the key 11 is complete, the movable plate 17 returns to the neutral position since the L-shaped drive member 14 is disengaged from contacting receiving block 16.

As the U-shaped portion of movable plate 17 continues to move upward, a greater amount of overlap occurs which causes an increase in plate area overlap between the fixed capacitor plate 20 and the movable capacitor plate 17. As the area of plate overlap increases, the capacitive value increases. The value of a capacitor is determined to be equal to the constant of permittivity $\epsilon 0$ times the area of the plates divided by the distance between the plates. The electrically conductive material 23 of the fixed capacitor plate 20 is insulated by the mylar sheets 22 and inserted through the U-shaped channel portion of the movable capacitor plate 17 and thus prevents the conductive areas from contacting and short circuiting the capacitor. Furthermore, since the conductive area of the movable plate 17 is the U-shaped portion, as illustrated in FIG. 2, the distance between the plates in the above equation remains constant. If the mylar sheets 22 are positioned directly in the middle of the U-shaped channel portion, the distances d1 and d2, respectively, from the mylar surfaces to each interior surface of the channel are equal and the combined distances form the distance for the above capacitive equation. If the mylar sheets are positioned off center, one of the distances to the interior surfaces of the U-shaped channel will decrease while the other will increase by a similar amount, thereby keeping the summed distance constant. This structure for the variable capacitor enables manufacture and assembly without extreme tolerance limitations. The only variable parameter in the capacitive equation is plate area, so as the movable capacitor 17 is forced upward the area of overlap with the fixed capacitor 20 increases and the variable capacitive value correspondingly increases. As the value of the variable capacitor increases, the peak amplitude of the high frequency input signal source passed by the variable capacitor increases.

If the key 11 is depressed in a soft or slow manner, the same mechanical action described above occurs except that the upward movement of the U-shaped channel position of the movable capacitor plate 17 is not great enough to cause any overlap with the head portion of electrically conductive pattern 23 of the fixed capacitor plate 20. The thin finger portion of the pattern 23 is used merely to make electrical connection with the input signal source and does not practically affect the value of the variable capacitance. In this soft touch mode of operation, no high frequency signal is passed to the input of the circuit means by the variable capacitor and only the standard keyboard contact K closes, which is separate and independent of the degree of depressive force applied to the key 11 but also causes the circuit means to operate. If the key 11 is depressed with a force sufficient to cause complete overlap between the head portion of the electrically conductive pattern 23 of the fixed capacitor plate 20 and the U-shaped channel portion of the movable capacitor plate 17, then the maximum peak amplitude of high frequency input signal is passed by the maximum valued variable capacitor to the input of the circuit means. As the amount of force applied to the key 11 is varied between these two extremes, an intermediate amount of overlap occurs and the value of the variable capacitor is proportionally altered. The peak amplitude of the high frequency input signal passed by the variable capacitor is proportional to the depressive force applied to the The depressive or impulsive force is the force applied to the key 11 by the instrument player during the length of time necessary to complete the down movement of the key.

As the U-shaped channel portion of the movable plate 17 moves upward, and before it overlaps with the head portion of pattern 23, it contacts the leaf spring 27. The lead spring 27 exerts a slight mechanical restraining force against the U-shaped arm. The spring 27 moves upward until its free end abuts the first stop member 30. The leaf spring 27, under continued upward pressure from U-shaped plate 17, now flexes at a point intermediate its length. The spring 27 flexes in this manner until an intermediate point contacts the second stop member 31 which prohibits further upward movement. Thus, on the upward swing, three different amounts of repressive force are exerted by the spring 27 against the U-shaped portion. The leaf spring 27, which initially functioned to retard upward movement of portion 17, now modifies its function and propels the portion 17 downward to the neutral or rest position. The leaf spring 27 is aided in its downward pressure against plate 17 by the return coil spring 24 and, of course, gravity. All contacting surfaces are covered by a cushioning material 33 to eliminate noise. The overlap of movable plate 17 and stationary plate 20, if any, is momentary since movable plate 17 returns to the neutral position regardless of whether key 11 remains depressed or is released.

The touch responsive mechanism comprising the force translation or linking components and the variable capacitive transducer operates to simulate the functioning of a musical instrument such as a piano and the like. The downward pressure on the key 11 is translated into lifting an element similar to the hammer used to strike the strings of a piano, then the element is propelled downward to the rest position again similar to the reaction of the piano string.

In FIG. 3, the depression of a standard electric musical instrument key closes the normally open keyboard contact K during the last two-thirds of downward travel. Each time the key is depressed the contact K will close and a predetermined voltage signal will be passed to the remainder of the circuit. This contact closing is separate and independent from the variable force applied to the key and the voltage signal passed is separate from the signal obtained as explained with reference to FIG. 1.

The depressive force applied to the key causes the variable capacitor 32 of the touch responsive mechanism 10 to pass a high frequency signal with a peak amplitude proportional to the force. The input signal source is the high frequency range Hartley Oscillator 50. It should be noted that any type of oscillator capable of producing a signal in the ultrasonic range could be used. The AC signal output of the velocity transducer 51, including the variable capacitor 32, is applied as the input through isolating resistor 52 to the base of the transistor 53. The collector of the transistor 53 is connected to ground through the resistor 54. The junction point between the collector of the transistor 53 and the resistor 54 is connected to the cathode of the diode 55. The emitter of the transistor 53 is connected to a negative voltage source, in the preferred embodiment negative twenty-eight volts (−28v) and to the base through resistor 49. The transistor 53 is normally in the off condition. The negative half cycle of the AC signal passed by the variable capacitor of the velocity transducer 51 and applied to the base of the transistor 53 does not effect the conductivity of the transistor 53 which remains in the off condition. The positive half cycle of the input signal switches the transistor 53 to the on condition. When the transistor 53 is in the on condition, the collector-emitter impedance is low and the negative voltage signal at the emitter is impressed across the low impedance of the collector-emitter path. As described with reference to FIG. 1, the depressive force applied to the key determines the amount of overlap in plate area in the variable capacitor 32. As the value of the capacitor increases, the peak amplitude of the high frequency signal applied to the base of the transistor 53 increases. If the plates of the variable capacitor 32 do not overlap, no signal is applied to the transistor 53. If the plates of the variable capacitor 32 completely overlap, a high frequency signal with a peak amplitude of approximately negative fifteen volts (−15v) is applied to the base of the transistor 53. Now as the peak amplitude of the input signal varies between the above maximum and minimum values, the conductivity of the transistor 53 proportionally varies between the normally off condition to the full on condition, low collector-emitter impedance. Correspondingly, the magnitude of the negative voltage signal applied to the cathode of the diode 55 varies between zero to −28 volts. The diode 55 has its anode connected to ground through the storage capacitor 56 and to the keyer circuit 57 through the isolating resistor 58. A tone generator 59 is connected to the keyer circuit 57 in the well known manner to generate a tone signal output corresponding to the key depressed by the instrument player. The tone generator 59 and the keyer circuit 57 are standard in the art and form a tone circuit and further description herein is not necessary.

The standard keyboard contact K has its open terminal X connected to a negative voltage source of −28 volts. The switch side terminal Y of the contact K is connected to a voltage divider circuit 60. The voltage divider circuit 60 comprises resistor 61 and resistor 62 which is connected to ground. The ratio between the resistance value of resistor 61 and resistor 62 is approximately 2:1. The junction between resistor 61 and resistor 62 is point A. The percussive parallel branch circuit 63 is connected between point A and point B, a point between the anode of the diode 55 and the capacitor 56.

The percussive parallel circuit branch 63 comprises a charging capacitor 64, a discharge resistor 65 and diode 66. The capacitor 64 is connected to point A and when the contact K is closed a voltage signal reduced by the voltage divider network 60 is stored on the capacitor 64. In the preferred embodiment, the voltage at point A is a negative ten volts (−10v). The capacitor 64 charges to a −10 volts. The cathode of the diode 66 is connected to capacitor 64 and passes the negative voltage signal to point B when it is forward biased. The low value resistor 65 is connected between capacitor 64 and diode 66 to ground and provides a rapid discharge path for capacitor 64. The capacitor 64 discharges so quickly through resistor 65 that it provides a −10 volt signal pulse each time the keyboard contact K is depressed regardless of the rapidity of the depressions.

The point A of the voltage divider network 60 is connected through isolating resistor 67 to point C. A first discharge parallel branch circuit 68 is connected between point C and a point D, a point between the point B and the capacitor 56. The parallel circuit functions as a discharge path for the capacitor 56. The parallel circuit 68 comprises a resistor 69 connected to point C and to the anode of the diode 70. The cathode of the diode 70 is connected to the point D. The point C is connected to the anode of isolating diode 71. The cathode of diode 71 is connected to the foot pedal sustain circuit 72.

A second discharge parallel branch circuit 73 is connected to a point E, a point between point D and the capacitor 56. The parallel branch 73 functions as a discharge path for the capacitor 56 and comprises the resistor 74 connected to point E and the foot pedal sustain circuit 72. The resistor 74 has a much greater resistance value than resistor 69.

The foot pedal sustain circuit 72 comprises a ganged switch 75 having switch contacts 76 and 77 operated by the depression of the foot pedal, not illustrated. In the normal position contact 76 is connected to the cathode of the diode 71 and through terminal S to ground. The contact 77 is connected to resistor 74 and through terminal M and potentiometer 78 to ground. The potentiometer 78 is connected to a negative voltage source, preferably −10v. When the foot pedal sustain is depressed, the contact 76 connects the cathode of the diode 71 through terminal T to a negative voltage source, preferably −10v; contact 77 connects resistor 74 through potentiometer 79 to ground. The potentiometer 79 is connected to a second negative voltage source, preferably −10v. The potentiometers 78 and 79 are adjustable to different settings to alter the negative voltage present at terminals M and N, thereby maintaining a constant decay slope of the voltage stored on capacitor 56 under either condition.

The operation of the circuit means illustrated in FIG. 3 depends upon the input signal received from the velocity transducer 51 and the closure of the keyboard contact K. If the key 11 is softly depressed with a minimum of force so that the plates of the variable capacitor 32 do not overlap, then no high frequence signal is passed to the base of transistor 53 by the variable capacitor 32. However, the contact K closes with every depression of key 11 regardless of the force applied, so the negative voltage signal of −28v is applied to the voltage division network 60. The 2:1 ratio of resistance values between resistor 61 and resistor 62 impresses approximately negative ten volts (−10v) at point A. The capacitor 64 charges to a negative ten volts and the diode 66 passes the negative signal to point B since it is forward biased. The negative ten volt signal is stored on the capacitor 56. The capacitor 64 rapidly discharges through resistor 65 and again charges to a negative ten volts upon the depression of key 11 closing contact K. The negative voltage stored on capacitor 56 begins to discharge and the envelope of the discharging voltage is impressed upon keyer circuit 57 to amplitude modulate the tone signal produced corresponding to the individual key 11 which is depressed.

If the key 11 is released after depression, the contact K will open. The diode 70 in the first discharge parallel circuit 68 is forwarded biased presenting a small resistance and the capacitor 56 discharges predominantely through this path including resistor 69 and resistors 67 and 62 to ground. A minor portion of the negative voltage stored on capacitor 56 discharges through resistor 74, but since the resistance value of resistor 74 is so large compared to the resistance value of resistor 69, the signal discharge through this path is minimal. Also, the capacitor 56 does not discharge through the small resistance value of resistor 54 since the diode 55 is reverse biased and therefore presents a very large resistance to the voltage on capacitor 56.

If the key 11 is depressed and maintained down the contact K will not open. In this situation, the negative ten volt signal at point A due to the voltage division network 60 remains. The first discharge parallel circuit 68 is effectively removed from the circuit as a discharge path since substantially the same voltage is present at point D and point C. The capacitor 56 therefore discharges through the second parallel circuit 73 comprising resistor 74. Since the resistance value of resistor 74 is much larger than the resistance value of resistor 69, the capacitor 56 discharges more slowly through resistor 74 than through resistor 69. Since the slope of the voltage discharge is different, the level of the tone signal produced by the keyer circuit 57 and the tone generator 59 rapidly diminishes when the voltage is discharged through resistor 69 and slowly diminish when the voltage is discharged through resistor 74.

If the key 11 is depressed with sufficient force to cause an overlap between the plates of the capacitor 32, a high frequency signal will be passed to the base of the transistor 53. As previously described, a negative voltage signal is present at point B. If the voltage contributed due to the variable capacitor 32 is less than the negative voltage at point A due to the keyboard contact K closure and the voltage divider 60, the circuit operates as described when the velocity transducer 51 produced no signal. However, if the action of the variable capacitor 32 results in a voltage at point B greater than the voltage at point A, the circuit operates as described hereinafter.

If complete overlap between the variable capacitive plates occurs and the maximum peak amplitude signal is passed by the velocity transducer 51 to the base of transistor 53, then the transistor 53 is full on and the maximum negative voltage is present at point B. In the preferred embodiment, the voltage at point B would be −28v. The negative ten volt signal pulse generated by the closure of contact K is ineffective due to the negative twenty-eight volts at point B. Therefore, the −28v signal is stored on capacitor 56. Now, if the contact K is released, the capacitor 56 will discharge through the first parallel discharge path comprising resistor 69 as previously explained. If the contact K remains depressed, approximately negative ten volt will be present at point C. The capacitor 56 discharges through the parallel path 68 until a charge of substantially negative ten volts remains. At this time the parallel circuit 68 becomes ineffective since a negative ten volts is present at point D and at point C. The remaining negative ten volt charge on capacitor 56 discharges through the parallel circuit path 73 comprising resistor 74. Thus, the combination of discharge circuit branch 68 and discharge circuit branch 73 form the dual slope discharge circuit which provides the envelope of the discharge voltage from capacitor 56 with a dual slope which changes at the negative ten volts point.

The use of the foot pedal sustain circuit 72 similarly affects the discharge paths. If the key 11 is depressed and released without engaging velocity transducer 51, a negative ten volts will be stored on capacitor 56 as described above and discharge will begin through the first discharge parallel circuit 68 comprising resistor 69. The level of the tone signal from the keyer circuit 57 begins to diminish rapidly. Now, if the foot pedal is engaged before depressing the key 11, the contact 76 is connected to terminal T and a negative ten volts signal will be passed by forward biased diode 71. The negative ten volts at point C removes the parallel circuit 68 comprising resistor 69 as a discharge path. The contact 77 engages terminal N which is connected through potentiometer 79 to ground. The charge on capacitor 56 discharges entirely through the second parallel circuit 73 comprising resistor 74. Thus, by engaging the foot pedal sustain 72, the slope of the voltage discharge is altered to reflect the slower discharge through the higher value resistance of resistor 74. The terminal N is connected to ground through potentiometer 79 which is set at a different value than potentiometer 78. The use of separate potentiometers is necessary to provide identical discharge slopes, since the voltage at point C with contact 76 connected to terminal S is diminished by the voltage drop across resistor 67 and is thereby slightly less than the voltage at point C when contact 76 is connected to terminal T. The terminals M and N are biased to a negative voltage to permit a long decay extinction point of the discharging voltage through resistor 74. The discharge circuit 68 is connected to ground since the long decay extinction point is not a consideration due to the rapid discharge through resistor 69.

It is to be understood that the present disclosure can be modified or varied by applying current knowledge without departing from the spirit and scope of the novel concepts of the invention.

I claim:

1. An apparatus for use in an electronic musical instrument having a plurality of juxtapositioned keys forming a keyboard and a tone circuit to produce a different tone signal output corresponding to the depression of each of said keys comprising:

source means for providing an AC signal;

a velocity transducer connected to said source means and to said keys and comprising:

capacitor means having a stationary plate and a movable plate for passing said AC signal in proportion to the impulsive force applied to one of said keys during depression by the instrument player;

linking means responsive to said keys for momentarily contacting said movable plate of said capacitor means and transferring said impulsive force applied to one of said keys to said movable plate;

said linking means after momentarily contacting said movable plate disengages from said movable plate regardless of maintained key depression by the instrument player;

said movable plate responsive to said linking means temporarily overlaps said stationary plate if said impulsive force exceeds a minimum value and said overlap is in proportion to said impulsive force and independent of maintained key depression by the instrument player whereby the value of capacitance increases with the degree of plate area overlap; and, circuit means responsive to said passed AC signal for generating a voltage signal envelope to control said tone circuit.

2. Apparatus as set forth in claim 1 wherein:

said stationary plate comprises an electrically conductive material sandwiched between two sheets of insulating flexible material; and said movable plate comprises an electrically conductive U-shaped portion forming a receiving channel through which said stationary plate is positioned, whereby in the rest position said movable plate does not substantially overlap the electrically conductive material of said stationary plate but does overlap in proportion to the force applied to one of said keys.

3. Apparatus as set forth in claim 1 wherein said linking means comprises:

a beam member for contacting said key;

an L-shaped drive member pivotally connected to said beam member;

a rod for contacting said drive member during its downward movement and causing it to rotate counterclockwise about said pivot connection; and a receiving block with a curved surface for engagement with said drive member.

4. Apparatus as set forth in claim 3 wherein said receiving block is positioned so that said curved surface slopes upward from the horizontal and said drive means engages said surface.

5. Apparatus as set forth in claim 4 wherein said receiving block is connected to said movable capacitor plate whereby the downward movement of the receiving block causes the movable plate to travel toward a momentary overlap condition with said stationary plate.

6. Apparatus set forth in claim 1 wherein:

said movable plate and said stationary plate are in a non-overlapping rest position prior to key depression; and, said velocity transducer further comprises restraining means for returning said movable plate to said rest position after said temporary overlap regardless of maintained key depression by the instrument player.

7. Apparatus for use in an electronic musical instrument having a plurality of juxtapositioned keys forming a keyboard and a tone circuit to produce a different tone signal output corresponding to the depression of each of said keys comprising:

source means for providing an AC signal;

a velocity transducer connected to said source means and to said keys for passing said AC signal in proportion to the force applied to one of said keys during the time interval taken to depress one of said keys; and, circuit means responsive to said passed AC signal and comprising:

input impedance means responsive to said passed AC signal for varying the value of impedance;

a voltage source connected to said input impedance means; and, storage means responsive to said input impedance means for receiving a proportion of said voltage and producing a voltage discharge envelope to control said tone circuit.

8. Apparatus as set forth in claim 7 further comprising:

a keyboard contact for closing each time one of said keys is depressed and connected to said voltage source;

a percussive circuit responsive to the closure of said keyboard contact and connected in parallel to said storage means for producing a voltage pulse, whereby said percussive circuit produces said voltage pulse each time one of said keys is depressed regardless of the force applied.

9. Apparatus as set forth in claim 8 further comprising:

a dual slope discharge circuit connected in parallel to said storage means for dissipating the voltage stored on said storage means.

10. Apparatus as set forth in claim 9 wherein said dual slope discharge circuit comprises in parallel:

a rapid discharge circuit including in series a blocking non-linear circuit element and a first resistor and connected to said keyboard contact; and a slow discharge circuit including a second resistor wherein the resistance value of said second resistor is much greater than the resistance value of said first resistor.

11. Apparatus as set forth in claim 10 wherein said storage means discharges through said slow discharge circuit when said keyboard contact remains closed and discharges through said rapid discharge circuit when said keyboard contact is released.

12. Apparatus as set forth in claim 10 wherein the level of the voltage signal discharge envelope is proportioned to the force applied to one of said keys when said voltage signal proportional to said input impedance is higher than said voltage pulse produced from said percussive circuit.

13. Apparatus as set forth in claim 12 wherein said storage means discharges through said rapid discharge circuit when said keyboard contact is released and discharges partially through said rapid discharge circuit then partially through said slow discharge circuit when said keyboard contact remains closed.

14. Apparatus as set forth in claim 10 further comprising:

a sustain circuit connected to said slow discharge circuit and to said rapid discharge circuit.

15. Apparatus for use in an electronic musical instrument having a plurality of juxtapositioned keys forming a keyboard and a tone circuit to produce a different tone signal output corresponding to the depression of each of said keys comprising:

source means for generating an AC signal;

touch responsive means connected to said keys and said source means and comprising:

linking means for transferring the force applied to one of said keys during the time interval taken to depress one of said keys; and, capacitor means responsive to said linking means for momentarily varying the value of capacitance in proportion to said force and responsive to said source means for passing said AC signal in proportion to said value of capacitance;

said capacitor means comprising:

a stationary plate comprising an electrically conductive material sandwiched between two sheets of insulating flexible material;

a movable plate comprising an electrically conductive U-shaped portion forming a receiving channel through which said stationary plate is positioned, said electrically conductive material of said stationary plate and said electrically conductive portion of said movable plate are in a nonoverlapping rest position prior to key depression; and, said electrically conductive portion of said movable plate responsive to said linking means overlaps said electrically conductive material of said stationary plate in proportion to the depressive force applied to one of said keys causing the value of the capacitance to increase with the degree of electrically conductive plate area overlap; and, circuit means responsive to said passed AC signal for producing a voltage signal envelope to control said tone circuit.

16. Apparatus as set forth in claim 15 wherein said linking means comprises:

a beam member for contacting said key, an L-shaped drive member pivotally connected to said beam member, a rod for contacting said drive member during its downward movement and causing it to rotate counterclockwise about said pivot connection, a receiving block having curved surface for engagement with said drive member and connected to said movable plate, said receiving block positioned so that said curved surface slopes upward from the horizontal whereby the downward movement of said receiving block causes said movable plate to travel toward an overlap condition with said stationary plate; and restraining means for returning said movable plate to the rest position.

17. Apparatus for use in an electronic musical instrument having a plurality of juxtapositioned keys forming a keyboard and a tone circuit to produce a different tone signal output corresponding to the depression of each of said keys comprising:

source means for generating an AC signal;

touch responsive means connected to said keys and said source means and comprising:

linking means for transferring the force applied to one of said keys during the time interval taken to depress one of said keys; and, capacitor means responsive to said linking means for momentarily varying the value of capacitance in proportion to said force and responsive to said source means for passing said AC signal in proportion to said value of capacitance; and, circuit means responsive to said passed AC signal and comprising:

input impedance means responsive to said passed AC signal for varying the value of impedance;

a voltage source connected to said input impedance means; and, storage means responsive to said input impedance means for receiving a proportion of said voltage and producing a voltage discharge envelope to contol said tone circuit.

18. Apparatus as set forth in claim 17 further comprising:

a keyboard contact for closing each time one of said keys is depressed and connected to said voltage source;

a percussive circuit responsive to the closure of said keyboard contact and connected in parallel to said storage means for producing a voltage pulse, whereby said percussive circuit produces said voltage pulse each time one of said keys is depressed regardless of the force applied.

19. Apparatus as set forth in claim 18 further comprising a dual slope discharge circuit connected in parallel to said storage means for discharging the voltage stored on said storage means and comprises in parallel:

a rapid discharge circuit including in series a blocking non-linear circuit element and a first resistor and connected to said keyboard contact; and a slow discharge circuit including a second resistor wherein the resistance value of said second resistor is much greater than the resistance value of said first resistor.

20. Apparatus as set forth in claim 19 wherein said storage means discharges through said slow discharge circuit when said keyboard contact remains closed and discharges through said rapid discharge circuit when said keyboard contact is released.

21. Apparatus as set forth in claim 20 wherein:

the level of the voltage signal discharge envelope is proportioned to the force applied to one of said keys when said voltage signal proportional to said input impedance is higher than said voltage pulse produced from said percussive circuit; and said storage means discharges through said rapid discharge circuit when said keyboard contact is released and discharges partially through said rapid discharge circuit then partially through said slow discharge circuit when said keyboard contact remains closed.

22. Apparatus as set forth in claim 19 further comprising:

a sustain circuit connected to said slow discharge circuit and to said rapid discharge circuit.

23. A circuit for use in an electronic musical instrument having a plurality of juxtapositioned keys forming a keyboard and a tone circuit to produce a different tone signal output corresponding to the depression of each of said keys comprising:

input means for receiving an input signal proportional to the force applied to one of said keys;

a keyboard contact for closing each time one of said keys is depressed;

a percussive circuit responsive to said closure of said keyboard contact for producing a voltage pulse independent of said force applied to said keys;

storage means responsive to said input means and said percussive circuit for producing a voltage discharge envelope to control said tone circuit;

said percussive circuit connected in parallel to said storage means; and, a dual slope discharge circuit connected in parallel to said storage means and including in parallel;

a rapid discharge circuit including in series a blocking non-linear circuit element and a first resistor and connected to said keyboard contact; and, a slow discharge circuit including a second resistor wherein the resistance value of said second resistor is much greater than the resistance value of said first resistor.

24. A circuit as set forth in claim 23 wherein the level of said voltage discharge envelope is proportional to the force applied to one of said keys when said input signal is larger than said voltage pulse produced from said percussive circuit.

25. A circuit as set forth in claim 24 wherein said storage means discharges through said rapid discharge circuit when said keyboard contact is released and discharges partially through said rapid discharge circuit then partially through said slow discharge circuit when said keyboard contact remains closed.

26. A circuit as set forth in claim 23 further comprising:

a sustain circuit connected to said slow discharge circuit and to said rapid discharge circuit.

* * * * *